US005435703A

United States Patent [19]

Lin

[11] Patent Number: 5,435,703

[45] Date of Patent: Jul. 25, 1995

[54] AIR PUMP WITH PRESSURE RELEASING MEMBER

[76] Inventor: Chi-Shou Lin, 3F, No. 4, Alley 15, Lane 89-25, Sin-Pin Rd., Tai-Pin Hsian, Taichung Hsien, Taiwan

[21] Appl. No.: 178,806

[22] Filed: Jan. 7, 1994

[51] Int. Cl.[6] ..... F04B 23/04

[52] U.S. Cl. ..... 417/428; 417/440; 417/521

[58] Field of Search ..... 417/428, 440, 521, 531, 417/569

[56] References Cited

U.S. PATENT DOCUMENTS 2,299,492 10/1942 Pfauser ..... 417/440
2,383,181 8/1945 Enslin et al. ..... 417/440
3,224,378 12/1965 Graham ..... 417/511
4,435,134 3/1984 Okada et al. ..... 417/428

*Primary Examiner*—Richard A. Bertsch
*Assistant Examiner*—Charles G. Freay
*Attorney, Agent, or Firm*—Browdy & Neimark

[57] ABSTRACT

An improved air pump comprises at least two parallel cylinder chambers communicating via two channels with a receiving space in which an air valve connecting device is disposed for injecting high pressure air into an object to be inflated. A pressure releasing member is disposed between the channels and the receiving space for regulating the pace of pumping the air into the object. When the air pressure inside the object is low, the pumping of the air into the object is done rapidly. When the air pressure inside the object has reached a high level, the pumping of the air into the object is done by only one cylinder chamber of the air pump.

10 Claims, 4 Drawing Sheets

AIR PUMP WITH PRESSURE RELEASING MEMBER

FIELD OF THE INVENTION

The present invention relates generally to an air pump, and more particularly to an air pump provided with means for improving the pumping efficiency and effect.

BACKGROUND OF THE INVENTION

The efficiency of a conventional air pump of the early model is rather limited in that the pumping of air is effected in a one-way manner that the air is driven into something, such as a tire, only when the piston of the pump is driven to move in a specific direction. However, such a conventional air pump was improved to an extent that the pumping of air could take place in a two-way fashion when the piston of the pump was caused to make a reciprocating motion. In order to improve further the efficiency and the effect of the conventional air pumps, the cylinders of the air pumps were diametrically enlarged to allow a greater amount of air to be driven into a tire and the like. However, such an improvement as mentioned above is also limited in that the pumping effect and the pumping efficiency are both undermined because the cross-sectional area of the pump cylinder is inversely proportional to the pressure, thereby causing a person to encounter with a difficulty in pumping even when the tire pressure has not reached a required level.

SUMMARY OF THE INVENTION

It is therefore the primary objective of the present invention to provide an improved air pump, which overcomes the shortcomings of the conventional air pumps described above.

The foregoing objective of the present invention is attained and described by embodiments which are described hereinafter in conjunction with the drawings provided herewith.

DETAILED DESCRIPTION OF THE INVENTION

Figure 1:
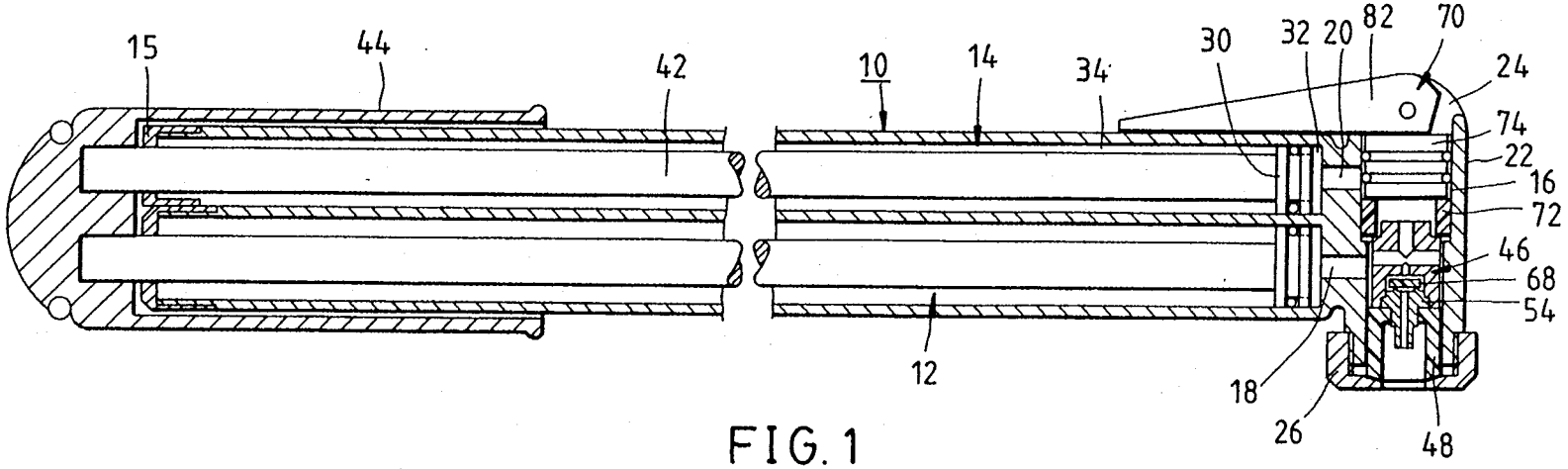
FIG. 1 shows a longitudinal sectional view of a preferred embodiment of the present invention.
Figure 2:
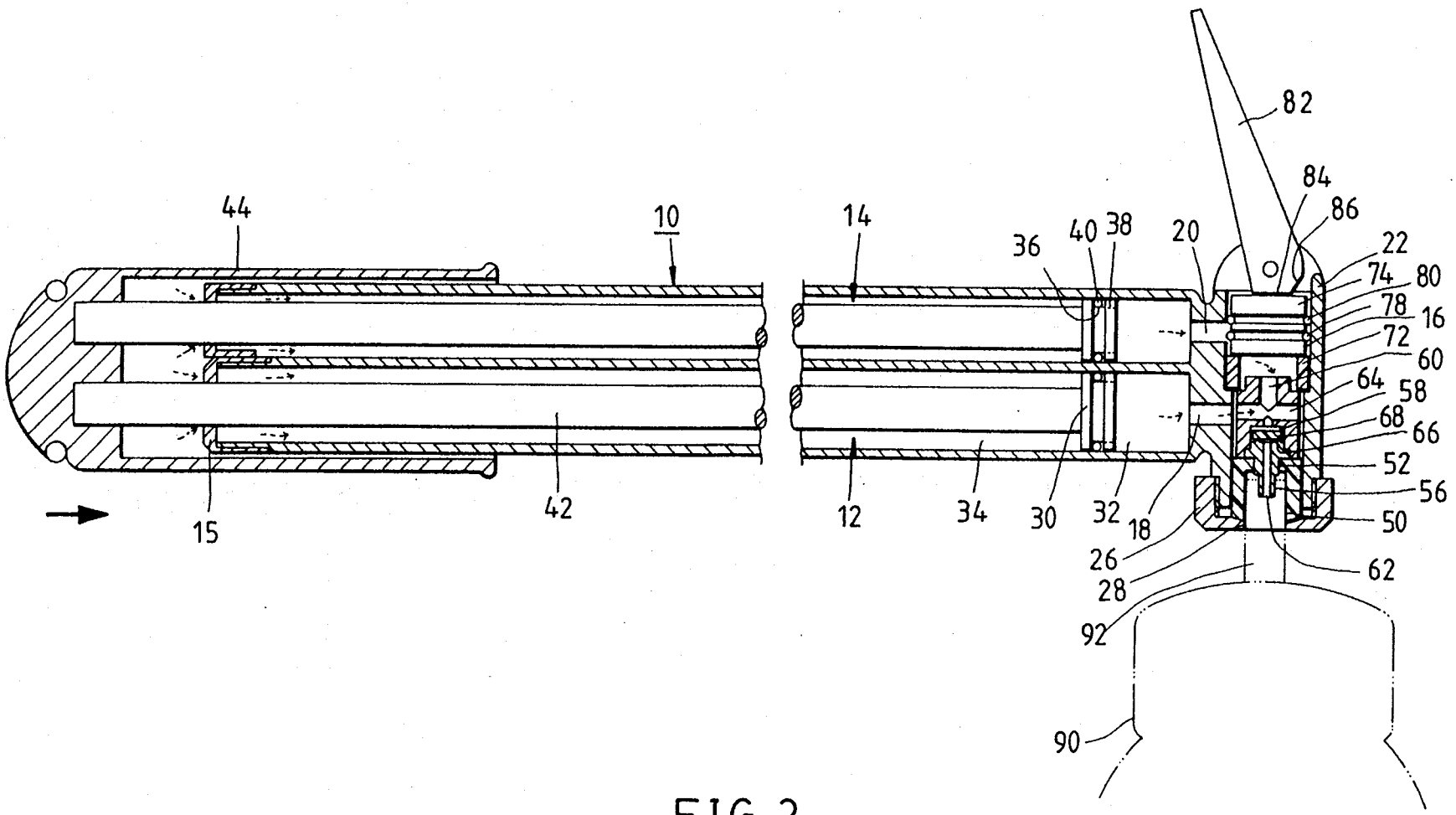
FIGS. 2 and 3 show schematic views of the pumping of a first preferred embodiment as shown in FIG. 1.

Referring to FIGS. 1 and 2, the first preferred embodiment of the present invention comprises a first cylinder chamber 12, a second cylinder chamber 14, a receiving space 16, a first channel 18 and a second channel 20 which are in communication with the first cylinder chamber 12, the second cylinder chamber 14 and the receiving space 16. The cylinder chambers 12, 14 and the channels 18, 20 are disposed in a cylinder 10 such that they are parallel to one another. The two cylinder chambers 12 and 14 have respectively a free end that is fitted into a cover 15. The receiving space 16 is disposed in a head 22, which is made separately or integrally with the cylinder 10. The receiving space 16 passes through the top and the bottom ends of the head 22. The channels 18 and 20 are connected respectively with the circumference of the receiving space 16. The head 22 is provided on the edge of the top end thereof with a pair of lugs 24. The head 22 is further provided at the bottom thereof with a pressing member 26.

Two pistons 30 are disposed respectively in the two cylinder chambers 12 and 14 such that the pistons 30 divide the cylinder chamber into a first air pressure chamber 32 and a second air pressure chamber 34. Each of the two pistons 30 is provided in the circumferential surface thereof with an annular groove 36 for disposing therein a leakproof ring 40. The annular groove 36 is provided with a cut 38.

Two piston rods 42 are disposed in the two cylinder chambers 12 and 14 and connected with the two pistons 30.

An air valve connecting device comprising:

a tightening member 48 of a plastic material and disposed under the receiving space 16;

a supporting member 54 provided centrally with a valve chamber 58 and at the top end thereof with a first air inlet 60 and a second air inlet 64, which are in communication with the valve chamber 58 having a bottom wall provided with a predetermined number of projections 66; and a valve piece 68 disposed in the valve chamber 58.

The supporting member 54 is disposed in the receiving space 16 such that the supporting member 54 is attached to the tightening member 48 and that the supporting portion 56 of the supporting member 54 is received in the inner holes 50 and 52 of the tightening member 48. The second air inlet 64 is corresponding in location to the first channel 18.

A pressure releasing member 70 is disposed between the receiving space 16 and the second channel 20 and is composed of the component parts described hereinafter.

A position limiting piece 72 is of an elastic element having an elasticity coefficient greater than that of the tightening member 48. The position limiting member 72 is disposed in the receiving space 16 such that the position limiting member 72 makes contact with the supporting member 54.

A pressure releasing piece 74 of columnar construction and having on the circumferential surface thereof two annular grooves in which a first leakproof member 78 and a second leakproof member 80 are disposed. The pressure releasing piece 74 is disposed in the receiving space 16 such that the pressure releasing piece 74 is urged by the position limiting piece 72. There is a gap between the bottom of the pressure releasing piece 74 and the top of the position limiting piece 72 for air to flow therethrough. The two leakproof elements 78 and 80 are corresponding in location to the outlet of the second channel 20.

A pressure adjusting piece 82 has one end provided with a first locating portion 84 and a second locating portion 86, which have respectively a slanted surface and which intersect at a predetermined angle. The pressure adjusting piece 82 is pivoted at that one end thereof to the lug 24 of the head 22 and is therefore capable of rotating on the pivoting point serving as a fulcrum. The distance between the second locating portion 86 and the pivoting point is greater than the distance between the first locating portion 84 and the pivoting point.

In operation, the tightening member 48 of the air pump of the present invention is fitted over the air valve 92 of a tire 90, as shown in FIG. 2. The pressing member 26 is so rotated as to cause the tightening member 48 to deform. The pressure adjusting piece 82 is pushed upwards to cause the pressure releasing piece 74, the position limiting piece 72 and the supporting member 54 to move downwards, thereby bringing about the deformation of the tightening member 48 so as to seal off the air valve 92. In the meantime, the first leakproof element 78 is corresponding in location to the outlet of the second channel 20 while the second leakproof element 80 is located between the second channel 20 and the top edge of the receiving space 16 so as to keep the receiving space 16 airtight. The two pistons 30 can be caused respectively to compress the first air pressure chambers 32 of the two cylinder chambers 12 and 14 by exerting a pressure on the hand grip 44 in a direction indicated by an arrow as shown in FIG. 2. As a result, the high pressure air is caused to flow to the receiving space 16 via the two channels 18 and 20. As the piston 30 is caused to compress the first air pressure chamber 32, the atmospheric air is injected into the second air pressure chamber 34 via the gap located between the piston rod 42 and the cover 15. The high pressure air is then caused to flow from the receiving space 16 to the valve chamber 58 via the second air inlet 64 of the supporting member 54. The high pressure air is subsequently allowed to enter the axial hole 62 of the supporting member 54 via the gap located between the valve piece 68 and the projection 66. It is the axial hole 62 through which the high pressure air is injected into the tire 90 via the air valve 92 of the tire 90. Similarly, the high pressure air in the second cylinder chamber 14 is caused to flow into the receiving space 16. Thereafter, the high pressure air is allowed to flow through the gap located between the pressure releasing member 74 and the position limiting member 72 before entering the valve chamber 58 via the first air inlet 60 of the supporting member 54. The high pressure air in the valve chamber 58 is finally injected into the tire 90 via the air valve 92. The receiving space 16 is airtight by virtue of the second leakproof element 80. As a result, no high pressure air is leaked out at the time when the operation of pumping the tire 90 by the two cylinder chambers 12 and 14 is under way.

Figure 3:
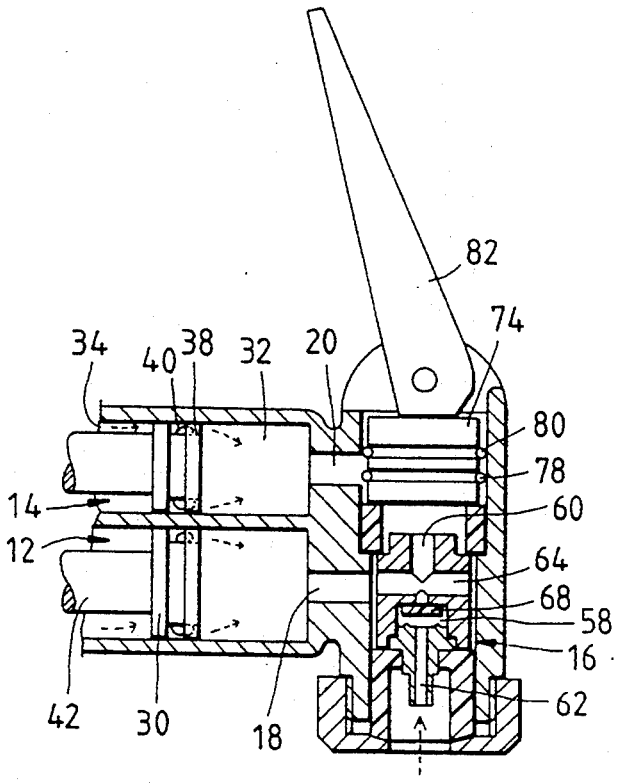

As shown in FIG. 3, when the piston 30 has reached the dead center of its forward movement and begun to move backwards, the air pressure in the second air pressure chamber 34 causes the portion of the leakproof ring 40, which is corresponding in location to the cut 38, to deform so as to allow the high pressure air to enter the first air pressure chamber 32. The piston 30 is no longer compressing the air to pump the air into the tire 90. As a result, the valve piece 68 is pushed upwards by the air pressure of the tire 90 to become attached to the top wall of the valve chamber 58, thereby sealing off the air inlets 60 and 64 to prevent the air in the tire 90 from leaking out.

As the piston 30 has reached the dead center of its backward movement, the action of pumping the tire 90 is resumed. The valve piece 68 is caused to move downwards so as to permit the passage of the air.

Figure 4:
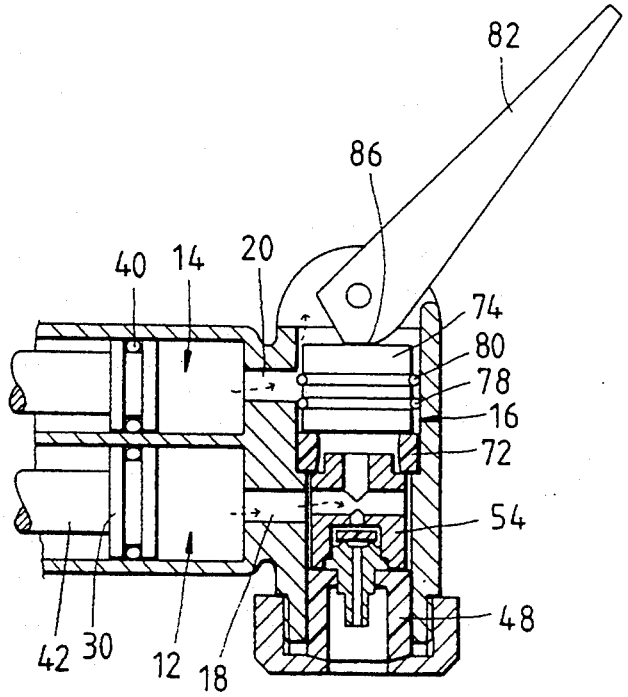
FIG. 4 is a schematic view showing that only one cylinder chamber of the pump of the present invention is at work at the time when the pressure is high.

The air pump with two cylinder chambers is very efficient in pumping the air into a tire. As the air pressure in the tire has reached a certain level, it becomes more difficult to pump additional air into the tire. Such a difficulty can be overcome by using only one of the two cylinder chambers 12 and 14 in the pumping operation. As shown in FIG. 4, the pressure adjusting member 82 is pushed upwards so as to cause the second locating portion 86 to press the pressure releasing member 74 downwards. The tightening member 48 continues to seal off the air valve of the tire by virtue of the deformation of the position limiting member 72. Upon completion of the downward movement of the pressure releasing member 74, the first leakproof element 78 is located under the second channel 20 to seal off the wall of the receiving space 16. As a result, the passageway located between the first channel 18 and the second channel 20 is obstructed. In the meantime, the second leakproof element is corresponding in location to the outlet of the second channel 20 and is no longer sealing off the circumferential surface of the receiving space 16, thereby forming a passageway located between the second channel 20, the pressure releasing member 74 and the receiving space 16. As the piston 30 is caused to compress the air in the cylinder chambers 12 and 14, the first cylinder chamber 12 generates a high pressure air, which is subsequently pumped into the tire. In the meantime, the air in the first air pressure chamber 32 of the second cylinder chamber 14 is caused to move by the piston 30 to be released to the atmosphere via the gap located between the second channel 20, the pressure releasing member 74 and the wall of the receiving space 16. In other words, the action of pumping the tire is carried out by the first cylinder chamber 12 only. The pumping action area of the piston 30 is therefore reduced substantially so that additional air can be pumped easily into the tire which has already been inflated previously to a certain level.

Figure 5:
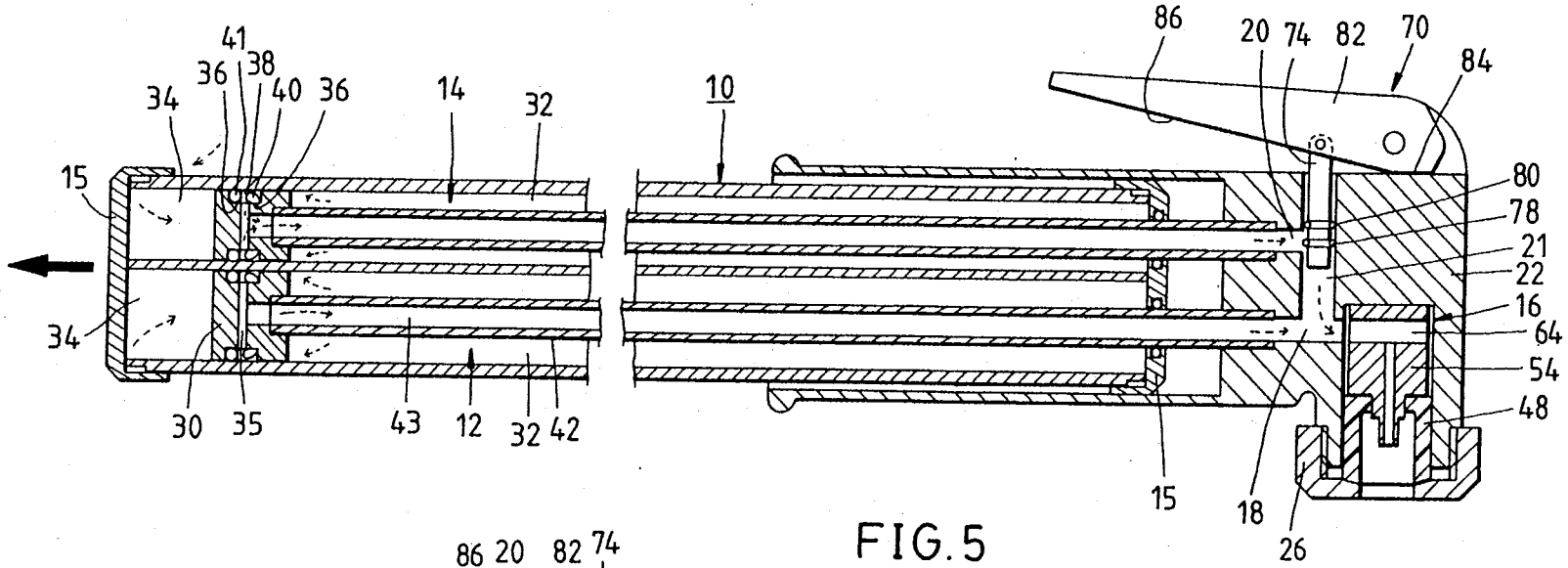
FIG. 5 shows a sectional schematic view of a second preferred embodiment in action, according to the present invention.

As shown in FIG. 5, the air pump of the second preferred embodiment of the present invention is different from that of the first preferred embodiment of the present invention in that the former has a piston 30 which is provided radially with an air hole 35, which is in turn provided in two sides thereof with leakproof rings 40 and 41. In addition, the piston rod 42 of the second preferred embodiment of the present invention is connected between the channels 18, 20 and the piston 30. The high pressure air formed by the compression brought about by the reciprocating motion of the piston 30 in either the first air pressure chamber 32 or the second air pressure chamber 34 is allowed to flow to the channels 18 and 20 via the air hole 35 and the duct 43 of the piston rod 42. The atmospheric air is injected into the second air pressure chamber 34 via a one-way valve (not shown in the drawings) located between both ends of the cylinder chambers 12, 14 and the cover 15.

The air pump of the second preferred embodiment, as shown in FIG. 5, comprises the component parts described hereinafter.

A receiving space 16 is disposed in such a manner that it is put through the bottom end of the head 22. The receiving space 16 is used to house the tightening member 48 and the supporting member 54, which are located by means of the pressing member 26.

The first channel 18 is connected with the receiving space 16 and is corresponding in location to the supporting member 54. The second channel 20 is not in communication with the receiving space 16. The two channels 18 and 20 are in communication with each other by means of an air duct 21 having one end connected with the first channel 18 and having another end connected with the second channel 20 such that another end passes through and beyond the head 22.

The pressure releasing member 70 comprises the pressure releasing member 74 of rod-shaped construction and the pressure adjusting member 82. The pressure releasing member 74 is provided with the first and the second leakproof elements 78 and 80. The pressure releasing member 74 is disposed in the air duct 21 such that the two leakproof elements 78 and 80 can seal off the air duct 21. The pressure adjusting member 82 is provided at one end thereof with a first locating portion 84 and a second locating portion 86. The pressure adjusting member 82 is pivoted at that one end mentioned above to the top end of the head 22. The body of the pressure adjusting member 82 is pivoted to the protruded end of the pressure releasing member 74 for actuating the pressure releasing member 74.

The two leakproof rings 40 and 41 disposed on the piston 30 work in a one-way manner that they prevent the air in the duct 43 and the air hole from entering the cylinder chamber. As a result, the supporting member 54 is not provided with the valve chamber 58 and the valve piece 68.

Figure 6:
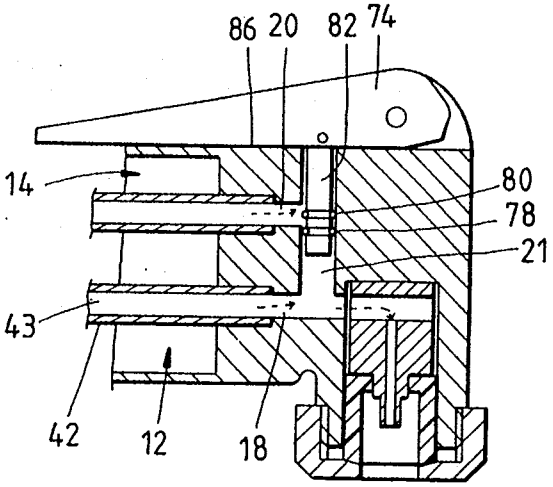
FIG. 6 is a schematic view showing that only one cylinder chamber of the second preferred embodiment as shown in FIG. 5 is at work.

In operation, the pressure adjusting member 82 is moved to cause the first locating portion 84 to be retained securely. The pressure releasing member 74 is actuated by the pressure adjusting member 82 to move upwards. In the meantime, the second leakproof element 80 is located at the second channel 20 to seal off the air duct 21 so as to isolate the second channel 20. The first leakproof element 78 is corresponding in location to the outlet of the second channel 20. The high pressure air formed by the compression in the first cylinder chamber 12 is injected into the tire via the first channel 18 and the receiving space 16. The high pressure air formed by the compression in the second cylinder chamber 14 is also injected into the tire via the air duct 21 and the first channel 18. After the tire pressure has reached a certain level, the pumping of the air into the tire may be carried out by only one cylinder chamber. The pumping of the air by one cylinder chamber is initiated by pulling the pressure adjusting member 82 to retain the second locating portion 86. The pressure releasing member 74 is actuated to move downwards, as shown in FIG. 6, to cause the first leakproof element 78 to seal off the air duct 21 so as to obstruct the passageway between the first channel 18 and the second channel 20. In the meantime, the second leakproof element is located at the outlet of the second channel 20. The first cylinder chamber 12 remains effective in pumping the air into the tire. The high pressure air formed by the compression in the second cylinder chamber 14 is released to the outside of the air pump via the air duct 21. The tire is therefore inflated to have a greater air pressure by means of only one cylinder chamber.

Figure 7:
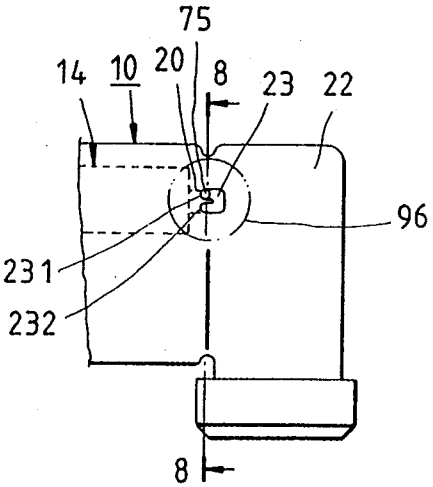
FIG. 7 shows a side elevational schematic view of a third preferred embodiment of the present invention.
Figure 8:
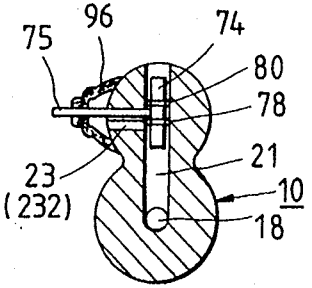
FIG. 8 shows a sectional view of a portion taken along the line 8—8 as shown in FIG. 7.

The third preferred embodiment of the present invention is shown in FIGS. 7 and 8 in which the definitions of the reference numerals are similar to those of the first preferred embodiment of the present invention. The third preferred embodiment is different from the first preferred embodiment in that the head 22 or one side of the circumferential surface of the cylinder body of the third preferred embodiment is provided with a slot 23 in communication with the air duct 21. The slot 23 is provided with a first locating portion 231 and a second locating portion 232. The portion of the pressure releasing member 74, which is located between the two leakproof elements 78 and 80, is provided radially with a protruded portion 75 which is put through and beyond the slot 23 when the pressure releasing member 74 is disposed in the air duct 21. A tapered leakproof body 96 of a soft material is fitted over the protruded portion 75 such that the tapered leakproof body 96 seals off the circumferential surface of the head 22 by means of the portion thereof having a greater diameter. The work of sealing off the head 22 with the tapered leakproof body 96 is done by means of a high frequency device. The portion of the leakproof body 96, which has a smaller diameter, is fitted over the protruded portion 75 in an airtight manner, as shown in FIG. 8, so as to ensure that the slot 23 is airtight.

The protruded portion 75 can be moved to locate between the first and the second locating portions 231 and 232. In the meantime, the pressure releasing member 74 is movable in both directions inside the air duct 21, thereby enabling the sealing positions of the two leakproof elements 78 and 80 to be altered so as to connect the first and the second channels 18 and 20 or to isolate the first and the second channels 18 and 20. As a result, the air pump of the present invention can be put into operation, with only one cylinder chamber working to pump the air into the tire or with both cylinder chambers working simultaneously to pump the air into the tire.

The embodiments of the present invention desribed above are to be regarded in all respects as merely illustrative and not restrictive. Accordingly, the present invention may be embodied in other specific forms without deviating from the spirit thereof. For example, the air pump of the present invention may be provided with three or more cylinder chambers. The present invention is therefore to be limited only by the scope of the following appended claims.

What is claimed is:

1. An improved air pump comprising:

at least two cylinder chambers;

at least one receiving space in which an air valve connecting device is disposed;

at least two channels connecting said cylinder chambers with said receiving space;

at least two pistons disposed respectively in said two cylinder chambers such that said two pistons can be actuated by two piston rods; and at least a pressure releasing member located between said receiving space and said channels such that said pressure releasing member is movable between a first position and a second position; wherein said pressure releasing member is located at said first position to isolate two fluid passageways formed between said two channels and said receiving space so as to enable said two cylinder chambers to communicate with said air valve connecting device through which air is pumped into an inflatable object; and wherein said pressure releasing member is located at said second position to allow at least one of said two fluid passageways to communicate with atmosphere in place of said air valve connecting device.

2. The improved air pump of claim 1 wherein at least one of said two fluid passageways has one side in communication with said atmosphere and another side in communication with said air valve connecting device; and wherein said pressure releasing member comprises a pressure releasing piece provided with at least one leakproof element, said pressure releasing piece being movable between a first position and a second position, with said pressure releasing piece being located at said first position so that said leakproof element is located at one side of an outlet of one of said two channels so as to isolate one of said two fluid passageways from said atmosphere, and with said pressure releasing piece being located at said second position so that said leakproof element is located at another side of said outlet of said one of said two channels so as to cause said one of said two fluid passageways to communicate with said atmosphere.

3. The improved air pump of claim 1 wherein said receiving space has two empty ends, with said air valve connecting device being located at one of said two empty ends; wherein said first and second channels are connected respectively with said receiving space, with said first channel communicating with said air valve connecting device; and wherein said pressure releasing member is disposed in said receiving space such that said pressure releasing member is corresponding in location to a fluid passageway formed by said second channel and said receiving space so as to control said second channel to communicate with said air valve connecting device or said atmosphere.

4. The improved air pump of claim 3 wherein said pressure releasing member comprises:

an elastic position limiting piece disposed in said receiving space such that said position limiting piece is adjacent to said air valve connecting device located at a bottom of said receiving space;

a pressure releasing piece provided thereon with at least a leakproof member and disposed in said receiving space such that said pressure releasing piece is supported by said position limiting member and that said pressure releasing piece is corresponding in location to an outlet of said second channel; and a pressure adjusting piece provided at one end thereof with at least one locating portion and pivoted at said one end thereof to a top end of said receiving space such that said locating portion presses against said pressure releasing piece and said position limiting piece so as to cause said pressure releasing piece to move between a first position and a second position; wherein when said pressure releasing piece is located at said first position, said leakproof element is located between said outlet of said second channel and said top end of said receiving space so as to cause said second channel to communicate with said air valve connecting device; and wherein when said pressure releasing piece is located at said second position, said leakproof element is located between said second channel and said air valve connecting device so as to cause said second channel to communicate from said top end of said receiving space with said atmosphere.

5. The improved air pump of claim 1 wherein said receiving space has one end that is empty so as to enable said air valve connecting device to be connected with an air valve of a tire; wherein said first channel is connected with said receiving space and said air valve connecting device; wherein said second channel, said first channel, and said atmosphere are in communication with one another.

6. The improved air pump of claim 1 wherein said receiving space has one end that is empty so as to enable said air valve connecting device to be connected with an air valve of a tire; wherein said first channel is in communication with said air valve connecting device and is provided with an air duct connecting said first channel and said second channel; and wherein said pressure releasing member has a pressure releasing piece, which is provided with at least one leakproof element and is disposed in said air duct such that said leakproof element can seal off said air duct, said pressure releasing piece being located at said first position to isolate said second channel from said atmosphere so as to cause said first channel and said second channel to communicate with each other, said pressure releasing piece being located at said second position to isolate said first channel from said second channel so as to cause said second channel to communicate with said atmosphere.

7. The improved air pump of claim 6 wherein said pressure releasing member comprises a pressure adjusting piece provided with at least one locating portion and pivoted to said pressure releasing piece so as to actuate said pressure releasing piece to move between said first position and said second position.

8. The improved air pump of claim 6 wherein said air duct is provided radially with a slot in communication with said atmosphere and having two locating portions; and wherein said pressure releasing member is corresponding to said pressure releasing piece and is provided thereon with a first leakproof element and a second leakproof element, which are spaced at a predetermined interval, said pressure releasing piece being provided radially a protruded portion extending from a portion thereof between said two leakproof elements which are located at said outlet of said second channel at such time when said pressure releasing piece is disposed in said air duct, said protruded portion being of a rod-shaped construction and extending through said slot to be moved by finger; and wherein a leakproof body is disposed airtightly between said slot and said protruded portion to insulate said slot from said atmosphere, said protruded portion capable of being moved to locate at said two locating portions to actuate said pressure releasing piece to move between said first position and said second position so as to cause said two leakproof elements to isolate said first channel or said second channel from said atmosphere.

9. The improved air pump of claim 1 wherein said air valve connecting device works in a one-way manner.

10. The improved air pump of claim 1 wherein said air valve connecting device comprises: an elastic tightening member provided axially with a hole and disposed in said receiving space such that said hole is fitted airtightly over an air valve of a tire to be inflated; a supporting member provided at the bottom thereof with a supporting portion having an axial hole at the bottom thereof and having at least one air inlet at the top thereof, said supporting member further being provided therein with a valve chamber communicating respectively with said air inlet and said axial hole; and a valve piece disposed in said valve chamber such that said valve piece works in a one-way fashion.

* * * * *